United States Patent [19]

De Bruin

[11] Patent Number: 4,769,739

[45] Date of Patent: Sep. 6, 1988

[54] ELECTRICAL SWITCHING APPARATUS ENCLOSURE HAVING A CONTROLLED OPENING DOOR FOR GAS VENTING

[75] Inventor: Willard H. De Bruin, Germantown, Wis.

[73] Assignee: Eaton Corporation, Cleveland, Ohio

[21] Appl. No.: 103,860

[22] Filed: Oct. 1, 1987

[51] Int. Cl.[4] ..... H01H 9/20; H01H 9/02

[52] U.S. Cl. ..... 361/335; 200/50 AA; 200/144 R

[58] Field of Search ..... 200/50 R, 50 A, 50 AA, 200/144 R, 300, 306; 174/50; 361/335, 344, 345, 390

[56] References Cited

U.S. PATENT DOCUMENTS

| | | | |
|---|---|---|---|
| 2,946,865 | 7/1960 | Thomas | 200/50 |
| 3,055,996 | 9/1962 | Beebe et al. | 200/50 |
| 3,059,072 | 10/1962 | Mekelburg et al. | 200/50 |
| 3,207,880 | 9/1965 | Mekelburg | 200/172 |
| 3,229,056 | 1/1966 | Turnbull | 200/50 A |
| 4,194,100 | 3/1980 | Cox et al. | 200/50 A |
| 4,218,596 | 8/1980 | Clausing | 200/144 R |
| 4,261,189 | 4/1981 | Brunfield, Jr. et al. | 70/84 |
| 4,293,153 | 10/1981 | Stanback et al. | 292/85 |
| 4,405,844 | 9/1983 | Dizon et al. | 200/50 A |

*Primary Examiner*—G. P. Tolin
*Assistant Examiner*—David Osborn
*Attorney, Agent, or Firm*—L. G. Vande Zande

[57] ABSTRACT

A handle operated door latching mechanism for moving upper and lower latch members into and out of engagement with a latching surface of an enclosure which becomes distorted by internal gas pressure to pull the latch members away from the latching surface, has one latch member formed longer than the other to permit release of the latching surface by the shorter latch member and limited opening of the door for exhausting the internal gas while the longer latch member remains in engagement with the latching surface to maintain the door substantially closed.

19 Claims, 5 Drawing Sheets

10d
2
2g
10
18a
42
4
10a
4a
28
30
22
25
3
3
38
2f
10b
14
44
18b
10e 10b
10
10d
14
2d
2
12
18a
20a
16
40
20
18f
42
38
10c
6
4b
6a
4a
4
32
32b
26
30
34
24
18d
32a
40
22a
22
36
18e
18c
18f
10a
2b
2c
8
2g
2f
40
20
20a
18b
18f
44
10e
2e

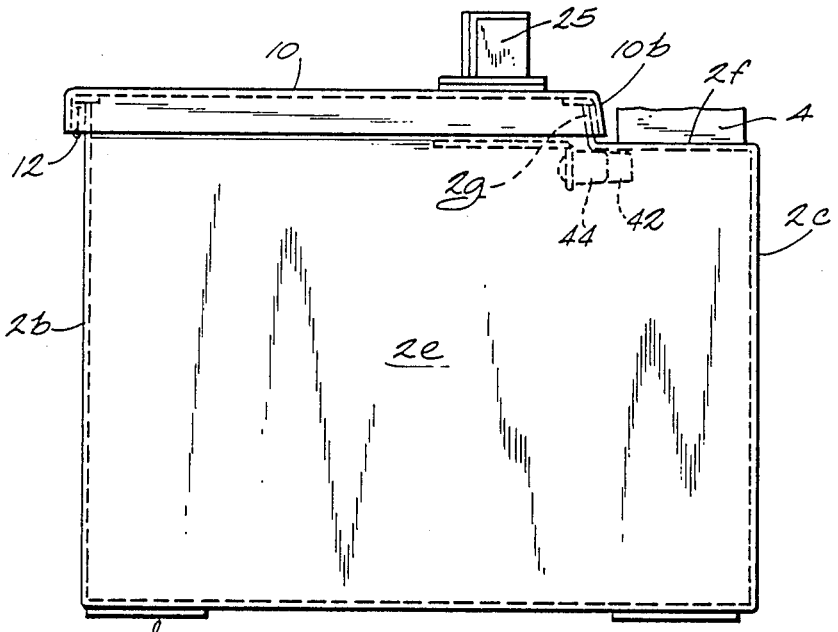
Fig. 5
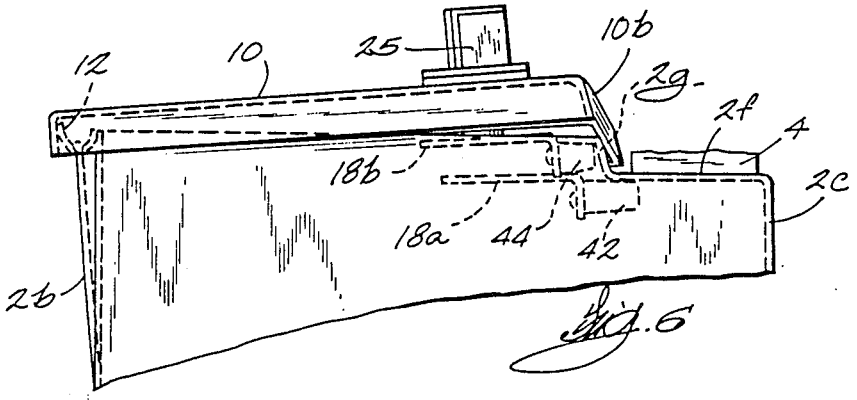
Fig. 6
Fig. 7
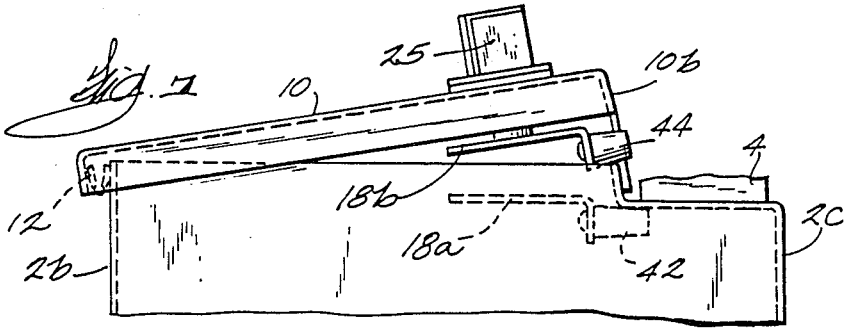

ELECTRICAL SWITCHING APPARATUS ENCLOSURE HAVING A CONTROLLED OPENING DOOR FOR GAS VENTING

BACKGROUND OF THE INVENTION

This invention relates to metal box-like enclosures for electrical switching apparatus. More particularly, the invention relates to enclosures of the aforementioned type having a hinged door which is securely latched in the closed position by a known latching and interlock mechanism commonly referred to as a "Thomas" interlock or "Detroit" interlock.

Enclosures of the aforementioned type are used for combination starters and similar apparatus to house a circuit protective switching device and an electromagnetically operated switching contactor for controlling the operation of an electric motor. The enclosure has an external operator for manually controlling the operation of the internally housed switching apparatus. The operator, switching apparatus and a door of the enclosure are interlocked to require the enclosure door to be securely latched before the switching apparatus may be operated. Although not a part of this invention, defeater mechanisms are provided to enable a person knowledgeable in the operation of such apparatus to open the door when the switching apparatus is in an ON condition and/or to operate the switching apparatus to an ON condition when the door is open. U.S. Pat. Nos. 2,946,865,3,055,996 and 3,229,056 are examples of enclosures of the aforementioned type.

Certain applications for enclosures of the aforementioned type require the door and case to be sealed by a gasket to prohibit the entrance of impurities such as dust or moisture. However, such gasketed construction also seals the enclosure to prevent exhaustion of pressurized gas generated within the enclosure when the switching apparatus is operated under fault current conditions. This situation can cause severe damage to the enclosure and potential danger to a human operator of the apparatus.

U.S. Pat. No. 4,194,100 discloses a circuit breaker enclosure having a hinged gasketed door, an external operator handle and spring biased external latches for the door. The door is permitted limited opening against the bias of the springs to permit pressurized gas to be exhausted without damaging the enclosure. However, the resilient latching of this patent would not have utility on an enclosure having a "Detroit" or "Thomas" interlock mechanism since such mechanism is intended to securely latch the door closed with a camming action.

U.S. Pat, Nos. 4,293,153 and 4,261,189 disclose latch assemblies for the door of an electric panelboard for circuit breakers. U.S. Pat. No. 4,293,153 incorporates a spring in the door pull assembly to permit limited opening of the door upon gas pressure buildup. U.S. Pat. No. 4,261,189 incorporates a pivoted retainer plate with a handle/lock assembly to permit limited opening of the door upon gas pressure buildup. In each instance, the panelboard door is not provided with a separate latching and interlock mechanism for securely holding the door closed.

SUMMARY OF THE INVENTION

The present invention provides an electrical switching apparatus enclosure having a door latching and interlock mechanism for securely latching a door thereof closed, but which permits the door of the enclosure to be blown partially open upon operation of the enclosed electrical switching apparatus under a fault current condition which generates pressurized gas within the enclosure. The door latching mechanism is provided with latching members at opposite ends of the door, the latching members having different lengths of engagement with a latching surface of the enclosure. Upon the generation of pressurized gas within the enclosure, a long unflanged side wall of the enclosure deforms or bulges to pull the door laterally to one side of the enclosure, thereby pulling the latching members in a direction away from the latching surface. The latching member having the shorter length of engagement with the latching surface releases its corresponding end of the door while the other latching member remains in substantial latching engagement with the latching surface, thereby to permit one end of the door to be opened by the pressurized gas while the other end of the door remains latched in its closed position. The predetermined partial opening of one end of the door permits the gas to be expelled or exhausted through that opening so as to reduce or eliminate the pressure buildup within the enclosure. The longer of the latching members maintains its engagement with the latching surface of the enclosure to maintain the door generally closed upon the enclosure.

The door latching mechanism may be reset to fully open the door or to relatch the door after the explosive gas generation described above. It has been discovered that several portions of the enclosure are subject to deformation during an explosion or rapid buildup of gas within the enclosure. Such deformation is utilized to achieve the controlled opening of the door for venting the gas. For example, the long side of the enclosure generally comprises a hinged connection between the door and the enclosure, the hinge itself and the wall of the enclosure deforming during the pressure buildup. The latch member itself may be deformed. The portion of the door which supports the latch member may also be deformed, as well as other portions of the door as it interfits with the box-like housing of the enclosure.

It is an object of this invention to provide an enclosure for electrical switching apparatus having a latching structure for securing the door of the enclosure closed, the latching structure having a simple and effective means for providing predetermined controlled opening of a portion of the door with respect to the enclosure to vent pressurized gas from within the enclosure.

It is a further object of this invention to provide an enclosure of the aforementioned type wherein the means to provide predetermined controlled opening of the door comprises a first latching member which has a predetermined length of engagement with a latching surface of the enclosure, such predetermined length being substantially greater than the predetermined length of engagement with said latching surface by a second latching member, whereby deformation of the enclosure due to pressurized gas generation therein effects release of the second latching member from the latching surface permitting limited opening of a corresponding end of the door while the first latching member maintains the door substantially closed.

These and other objects and advantages of the invention will become more apparent in the following description and claims when read in conjunction with the accompanying drawings.

BRIEF DESCRIPTION OF THE DRAWAINGS

Figure 1:
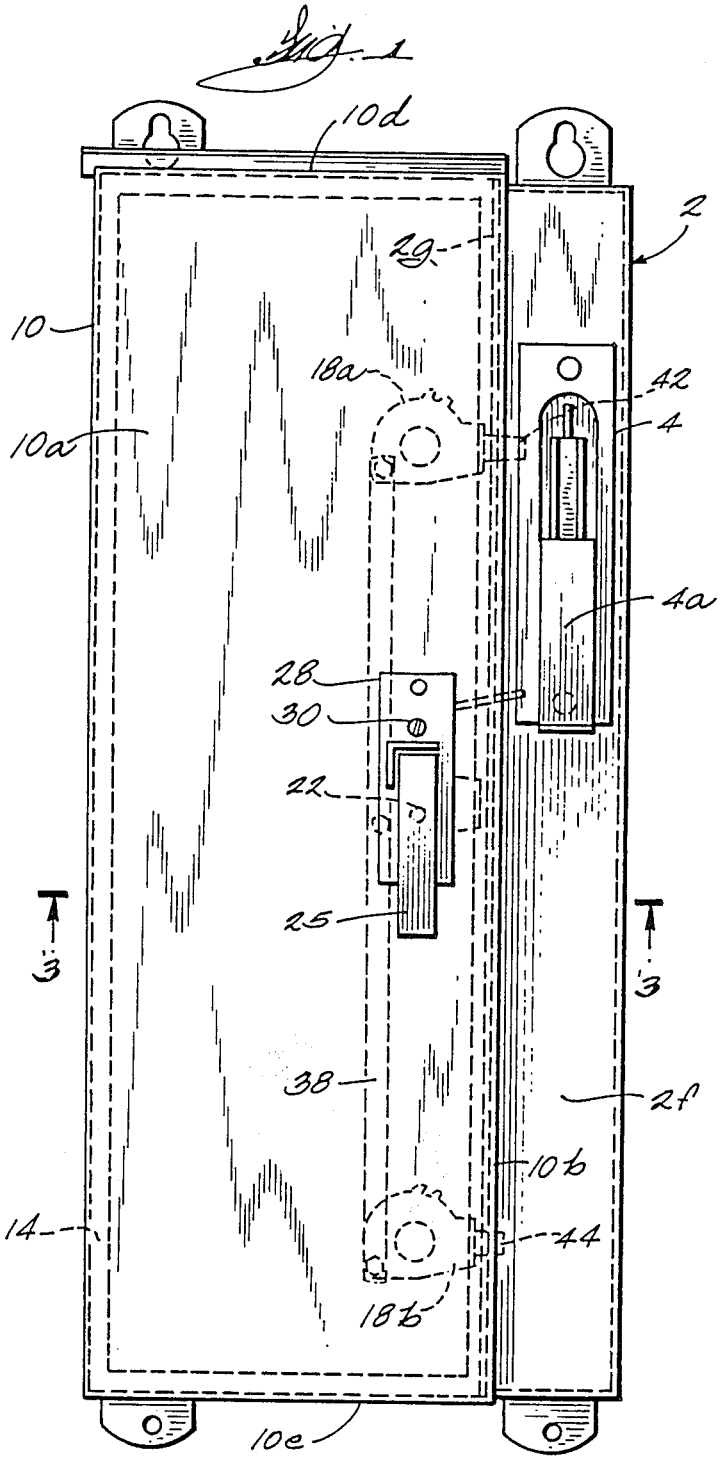
FIG. 1 is a front elevation view of an enclosure for electrical switching apparatus constructed in accordance with this invention.
Figure 3:
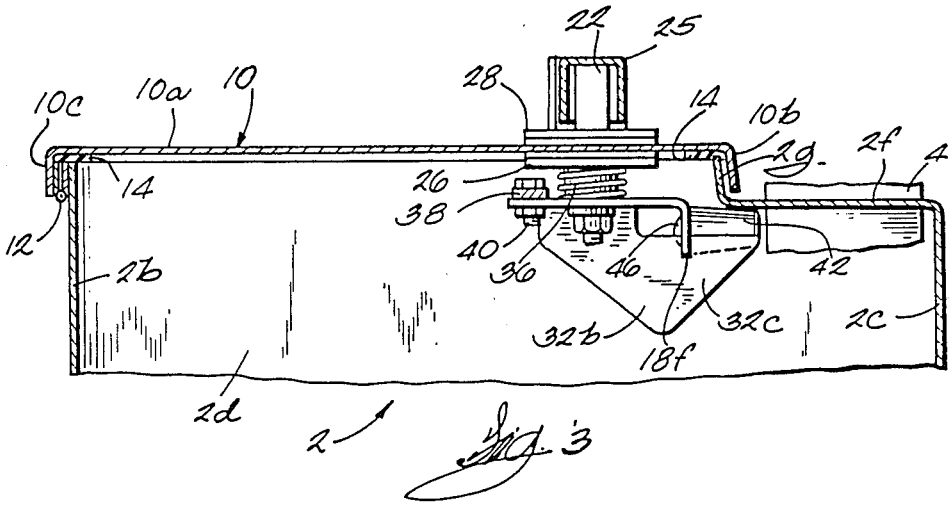
Figure 10:
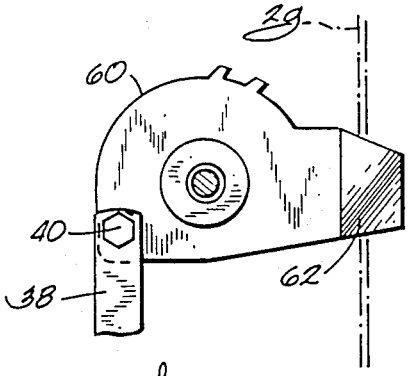
Figure 11:
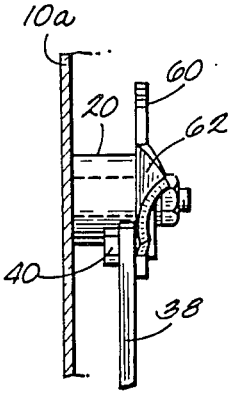
Figure 8:
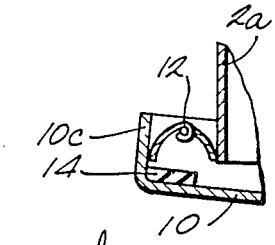
Figure 4:
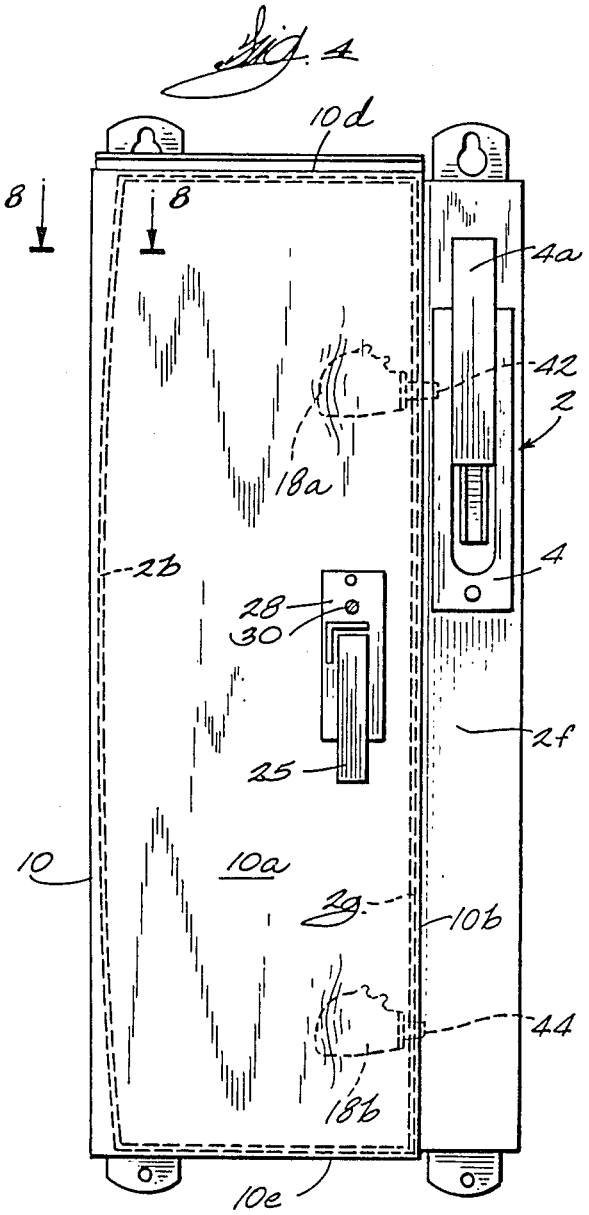
Figure 9:
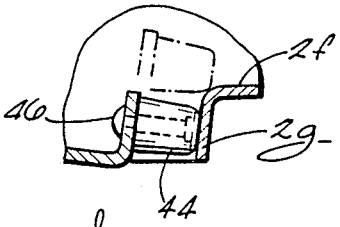

FIG. 3 cross sectional view through the enclosure taken along the line 3—3 in FIG. 1 showing a latching member engaging a surface of the enclosure and a backup catch member which also functions to reset the latching mechanism to a releasing position when the door is attempted to be closed upon the enclosure without first moving the latching mechanism to a releasing position;

FIG. 4 front elevation view similar to FIG. 1, but showing the side wall of the housing and a lower portion of the door in a distorted, deformed condition due to a pressurized gas buildup within the enclosure;

FIG. 5 is an end view of the lower end of the enclosure of Figs. 1–4 the door closed;

FIG. 6 is a fragmentary view similar to FIG. 5 but showing the housing deformed at the left-hand side wall as shown in FIG. 4 and showing the short latching member of the door latching mechanism moving free of the latching surface of the enclosure and the lower end of the door moving to a partially open position;

FIG. 7 a view like FIG. 6 but showing the door and lower latch member in a final position after exhausting the gas buildup generated within the enclosure;

FIG. 8 is a fragmentary sectional view taken along the line 8—8 in FIG. 4 near one end of the enclosure the enclosure side wall, door and hinge in a deformed condition as a result of a gas pressure buildup within the enclosure;

FIG. 9 is a fragmentary sectional view of the lower latching member of FIG. 4 to an enlarged scale showing the progression of the latching member around a leading edge of the enclosure latching surface as the lower end of the door moves to a partially open positon;

FIG. 10 is a fragmentary view of an alternate embodiment of the latching member for the enclosure; and FIG. 11 is a side view of the alternate embodiment latching member seen in FIG. 10.

DESCRIPTION OF THE PREFERRED EMBODIMENT

Figure 2:
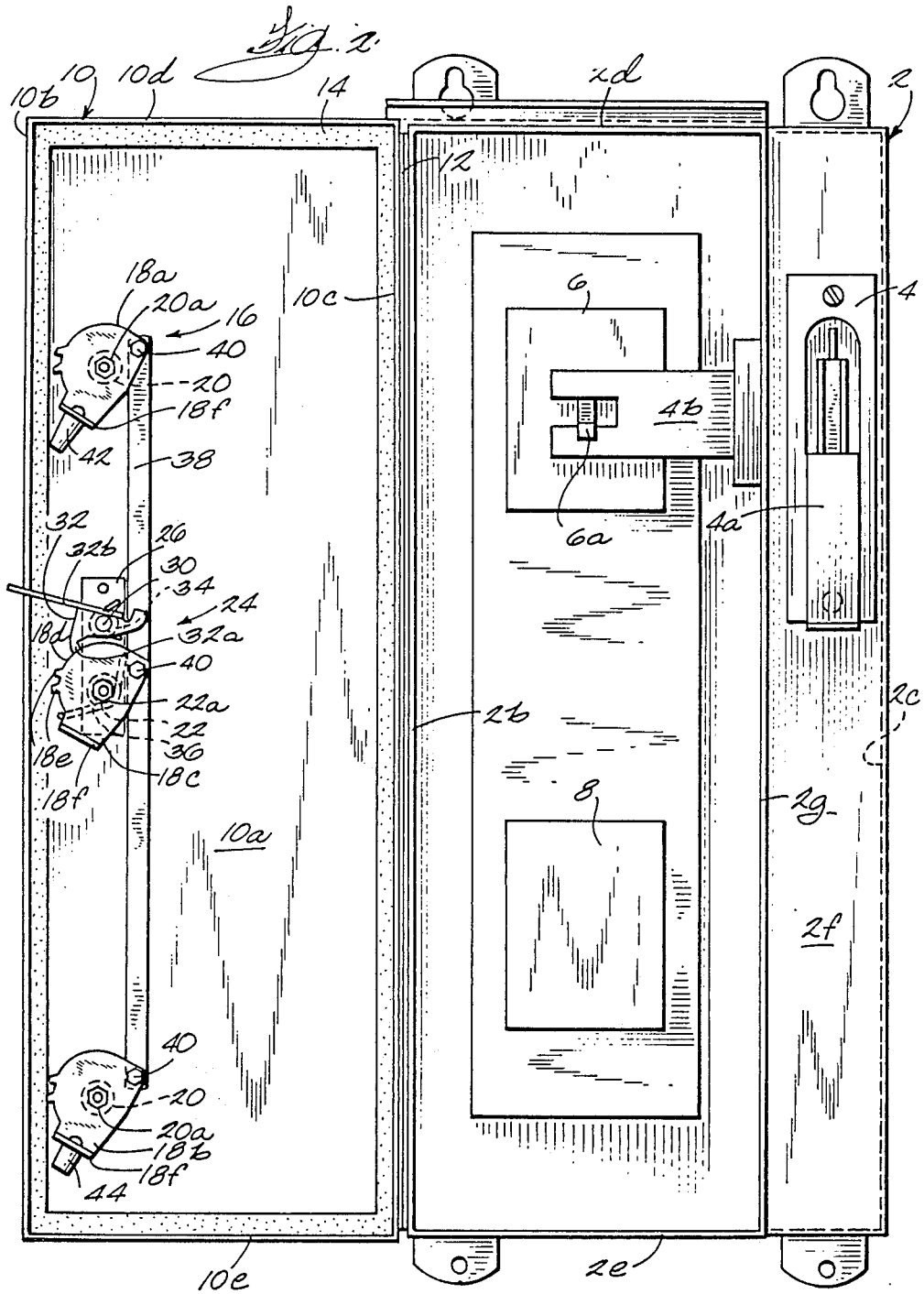
FIG. 2 is a front view of the enclosure of FIG. 1 with the door in an open position showing electrical switching apparatus housed within the enclosure and the latching assembly for the door.

Referring particularly to FIGS. 1–3 of the drawings, an enclosure for electrical switching apparatus constructed in accordance with this invention is shown to comprise a box-like sheet metal enclosure 2 having a rear wall 2*a* and a left side wall 2*b*, a right side wall 2*c*, an upper end wall 2*d* and a lower end wall 2*e* each extending forwardly from rear wall 2*a*. The right side wall 2*c* comprises a leftward extending front wall 2*f* which terminates in a forwardly projecting flange 2*g*. The side wall 2*b*, end walls 2*d* and 2*e* and forwardly extending flange 2*g* define a front opening for the enclosure. A manual operating mechanism 4 is mounted on the front wall 2*f* and has a pivotally mounted handle 4*a* which may be manually operated between a down position illustrated in FIG. 2 and an upper position illustrated in FIG. 4 to operate an internal drive link 4*b*. Drive link 4*b* has an operative connection with the operating lever 6*a* of a circuit breaker 6 or the like mounted within the enclosure 2. Also housed within the enclosure 2 is an electromagnetically operated contactor 8 which may be electrically connected to the circuit breaker 6 by connections (not shown).

A door 10 is hinged to the enclosure 2 along the forward edge of left side wall 2*b* by an elongated continuous hinge 12. Door 10 comprises a flat planar front panel 10*a* and a rearwardly extending peripheral skirt formed by side wall flanges 10*b* and 10*c* and end wall flanges 10*d* and 10*e*. When door 10 is swung to its closed position overlying the open front of enclosure 2, the peripheral skirt overlies the respective walls 2*b*–2*d* and forwardly projecting flange 2*g* of the enclosure on the exterior sides thereof. A rectangular gasket 14 is disposed on the internal surface of door 10 adjacent the respective side and end wall flanges to extend around the internal periphery of front panel 10*a* and overlie the forward edges of the respective walls and flange defining the front opening of enclosure 2 when the door is closed thereon.

A door latching and interlock mechanism 16 of the "Detroit" interlock type is provided on the interior surface of panel 10*a* of door 10. Although the mechanism 16, enclosure 2 and operator mechanism 4 include operational interlock functions, such interlock functions are not a part of this invention and therefore only the door latching functions of the mechanism 16 will be described herein. Door latching mechanism 16 comprises a pair of identical latch plate members 18*a* and 18*b* rotatably mounted upon respective shouldered posts 20 which are suitably attached to the interior surface of door panel 10*a* near the upper and lower ends thereof. Posts 20 have threaded reduced diameter shafts extending axially therefrom which receive nuts 20*a* for securing the latch plate members 18*a* and 18*b* thereto.

A centrally disposd latch plate 18*c* similar to latch plate members 18*a* and 18*b* is securely affixed by element 22*a* to a shaft 22 which is a part of a latch assembly 24 and is journaled for rotation through door panel 10*a* to have an operating handle 25 affixed to the external end thereof. Assembly 24 comprises an internal mounting plate 26 and an external mounting plate 28 secured to opposite sides of the front panel 10*a* of door 10. A shaft 30 is also journaled in plates 26 and 28 and door panel 10*a* immediately above shaft 22. A latch member 32 is affixed to the interior end of shaft 30. Member 32 has a hook 32*a* abutting against an arcuate surface 18*d* of center latch plate 18*c*. The exterior end of shaft 30 is provided with a screwdriver slot for effecting rotation of latch member 32 from the exterior of the enclosure.

Referring particularly to FIG. 2, latch plate 18*c* is provided with a pair of projections 18*e* on the arcuate surface 18*d*. A helical torsion spring 34 is disposed around shaft 30 to attach to plate 26 at one end and to the latch member 32 at another end to provide counterclockwise bias to the latch member 32 as viewed in FIG. 2. A torsion spring 36 is disposed around the shaft 22 and attached to plate 26 and latch plate 18*c* to provide a counterclockwise bias to the latch plate 18*c*. A drive link 38 extends along the righthand side of the latch plates 18*a*, 18*b* and 18*c* (as viewed in FIG. 2) and is rotatably connected to each of these members by bolts 40 for effecting simultaneous movement of the latch plate members 18*a*, 18*b* and 18*c*.

Latch plates 18*a*, 18*b* and 18*c* have a right-angle flange 18*f* formed thereon. The upper and lower latch plate members 18*a* and 18*b* have roller latch members 42 and 44, respectively, secured to the respective flange 18*f* by a shouldered rivet 46 which extends through an axial opening in the respective roller and is affixed to the flange 18*f*. As may be seen in FIGS. 1, 2, 4, 6 and 7, the roller 42 attached to latch plate 18*a* is substantially longer than the roller 44 attached to latch plate 18*c*.

Torsion spring 36 biases latching mechanism 16 to the position shown in FIG. 2 wherein rollers 42 and 44 are withdrawn within the periphery of the door 10. Latching plate 18*c*, may be rotated clockwise as viewed in FIG. 2 against the bias of spring 36 by rotating handle 25 until hook 32*a* sequentially engages with the second tooth 18*e* of latch plate 18*c* thereby latching the mechanism 16 in the position shown in FIG. 1 with rollers 42 and 44 extending beyond the periphery of door 10. The mechanism 16 may be released to return to the position shown in FIG. 2 by rotating shaft 30 with a screwdriver from the exterior of door 10 to rotate latch 32 clockwise as viewed in FIG. 2, causing hook 32*a* to release the respective teeth 18*e* and permitting spring 36 to move latch plates 18*a*, 18*b* and 18*c* counter- clockwise.

As seen in FIGS. 1–3, latch member 32 also has a depending leg portion 32*b* which projects beyond the periphery of door 10. The lower surface of leg 32*b* is provided with an angular cam surface 32*c* which engages the forward edge of forwardly projecting flange 2*g* when the door is moved to a closed position to rotate the latch 32 clockwise as the door is moved to the closed position. Such rotation of latch 32 will effect the release of hook 32*a* with the projections 18*e* on latch plate 18*c* to release the mechanism 16 in the event the mechanism is in the FIG. 1 position when attempting to close the door, thereby permitting the torsion spring 36 to move the mechanism 16 to the position shown in FIG. 2 wherein the rollers 42 and 44 are withdrawn internally of the exterior periphery of door 10. In its normal position, flange 32*b* of latch plate 32 extends beyond the periphery of door 10 to serve also as a catch to prevent opening of door 10 unless latch 32 is manually rotated by a screwdriver in the appropriate direction such that the projecting end of flange 32*b* clears the enclosure latching surface created by the under side of front wall 2*f*.

When the latching mechanism 16 is in the position shown in FIG. 2, door 10 may be closed and the handle 25 may be rotated counterclockwise as viewed in FIG. 1 to move the latching mechanism 16 and particularly rollers 42 and 44 under the enclosure latching surface formed by the interior surface of front wall 2*f*. To facilitate the camming action of the door 10 tightly closed upon the enclosure 2, the leading edge of the latching surface created by the juncture of front wall 2*f* and forwardly projecting flange 2*g* is radiused to provide a smooth transition between these two surfaces. The outer ends of rollers 42 and 44 are also radiused to provide smooth surface engagement with the leading edge of the latching surface when the latching mechanism is operated by handle 25 to securely latch door 10 to enclosure 2. The latching plates 18 and the rollers 42 and 44 are arranged to draw the door 10 tightly upon the enclosure, thereby compressing gasket 14 upon the forward edges of side walls 2*b*, forwardly projecting flange 2*g* and end walls 2*d* and 2*e*.

In the event the switching apparatus 6 and 8 is operated when a fault current is present, the arc generated from the switching apparatus creates a substantial amount of pressurized gas within the sealed enclosure 2. Sufficient force is associated with this gas pressure to cause substantial damage to the sealed enclosure 2, i.e. to blow the door 10 open and/or off the hinges of the enclosure. To prevent this undesirable action, it is preferable to vent the gas at a predetermined location on the enclosure before the door is completely blown open or off. This is accomplished in a simple and expedient manner in the instant invention through the provision of a long roller at one end and a short roller at the other end of the door 10 such as long roller 42 shown near the upper end of door 10 adjacent operator mechanism 4 and shorter roller 44 shown near the lower end of door 10, away from operator mechanism 4.

As seen in FIG. 4, the switching apparatus has been operated to its ON position with the handle 4*a* in the upper position. An arc occurring within the enclosure has generated substantial gas pressure, causing left side wall 2*b* to bulge or deform leftward along its forward edge. As seen in partial section in FIG. 8 the hinge 12 significantly deforms near the upper and lower ends of the enclosure and door and may in fact separate slightly its attachment to the respective door or enclosure side wall at the extreme ends thereof. This deformation of enclosure side wall 2*b* moves door 10 laterally to the left, causing right-hand rearwardly extending flange 10*b* of door 10 to move into direct engagement with the exterior surface of flange 2*g*. It may be seen in FIG. 3 that the flange 10*b* and flange 2*g* are originally formed at a slight angle and that a space is provided between the two flanges. Upon the leftward lateral movement of door 10, the flange 10*b* moves door 10 outwardly away from the enclosure 2 as it rides on the flange 2*g*. Also, the front panel 10*a* of door 10 buckles or deforms slightly in the areas where posts 20 are attached to the panel 10*a* and the latch plates 18*a* and 18*b* and rollers 42 and 44 tend to distort downwardly as the door 10 moves outwardly along the flange 2*g*. Such distortion and leftward movement of door 10 pulls the free end of short roller 44 around the radiused leading edge of the latching surface provided by the interior surface of front wall 2*f* to the interior side of flange 2g as shown in FIGS. 6 and 8. At this point, door 10 is open slightly with respect to enclosure 2 at the lower right-hand corner thereof and some gas may begin to escape through this opening, but continued impetuous from the rapid buildup of gas pressure within the enclosure carries the lower right-hand corner of door 10 further outward until roller 44 clears the forward edge of flange 2*g* whereupon the wall 2*b* and flange 2*g* of enclosure 2 return toward their normal nondistorted position when the gas is substantially exhausted and the pressure reduced. This condition is illustrated in FIG. 7 wherein roller 44 is disposed between the forward edge of flange 2*g* and the rearward edge of flange 10*b* of door 10, thereby maintaining the lower right-hand corner of door 10 ajar in the open position. By selectively predetermining the lower end of door 10 to be partially opened for exhausting the hot gases generated within the enclosure, the gases are directed away from operator handle 4*a* to protect the hand of a workman who may be operating the switching apparatus when the gases are generated. The continued engagement of long roller 42 with the latching surface at the upper end of the door while gas is venting from the lower end maintains the door substantially closed on the enclosure 2. Some permanent deformation of the hinge 12 or of the enclosure 2 may cause the lower end of the door to be misaligned with the flange 2*g* after the gas has been vented. However, the operating handle 4*a* may subsequently be moved to the lower OFF condition for the electrical switching apparatus and the door latching mechanism handle 25 may be operated upon the proper release of latch 32 to move the latch plates 18 and respective rollers 42 and 44 to their door unlatching position as shown in FIG. 2 thereby moving the roller 44 interiorly of the enclosure and out of interfering engagement with the forward edge of flange 2*g* and the rearward edge of flange 10*b*. If any permanent deformation occurs, the door can be forced down over flange 2*g* by virtue of the fact that the upper end thereof is still in overlapping engagement with the flange 2*g* and such operation may serve to reduce any deformation in the hinge or left side wall 2*b*. In any event, rotation of the latch 32 to a position wherein it clears the latching surface will enable door 10 to be opened for inspection of the apparatus.

The latching assembly may have modified latching plates 60 as shown in FIG. 10 wherein an extension 62 of the latching plate 60 replaces the roller 42 or 44. Extension 62 is formed to have a curled or curved end for engagement with the radiused leading edge of the latching surface to facilitate the cammming and latching operation of the mechanism. The length of the extension 62 is made longer for the latching plate 60 which is to be located at the upper end of the mechanism and is made shorter for the latching plate that is to be located at the lower end of the mechanism in keeping with the teachings of this invention as applied to rollers 42 and 44. In all other aspects, the alternative embodiment of FIGS. 10 and 11 functions the same as aforedescribed. It will be appreciated that the embodiment herein described is susceptible of various other modifications without departing from the scope of the appended claims.

I claim:

1. An enclosure containing electrical switching apparatus comprising:

a box comprising a rear wall, opposed pairs of side and end walls extending forwardly from said rear wall, an open front, a door hinged along one of said side walls for pivotal movement between an open position and a closed position overlying said open front, and a latching surface near a forward edge of the other of said side walls;

door latch means comprising first and second latching members mounted to said door, said latching members being movable to engage said latching surface and cam said door to said closed position, said first latching member being arranged to extend a greater distance beyond a leading edge of said latching surface than said second latching member;

said one of said side walls being distortable outwardly along its forward edge upon increased pressure within said box caused by arc gases generated by fault currents in said switching apparatus, distortion of said one of said side walls moving said door laterally away from said other of said side walls to pull said second latching member free of said leading edge of said latching surface, said pressure thereafter forcing said door at said second latching member outward in an opening direction to exhaust said arc gases without pulling said first latching member free of said leading edge, said first latching member cooperating with said latching surface to maintain said door substantially in said closed position.

2. The enclosure defined in claim 1 wherein said door seals said open front when said door is cammed to said closed position by said latching members.

3. The enclosure defined in claim 2 further including gasket means disposed between said door and peripheral edges of said open front.

4. The enclosure defined in claim 1 wherein said second latching member is mounted to said door in proximity to one end of said door.

5. The enclosure defined in claim 1 further comprising external operating means for operating said switching apparatus, said operating means being mounted on said enclosure in proximity to one end of said door, and said second latching member is mounted to said door at an opposite end thereof.

6. The enclosure defined in claim 1 wherein said first and second latching members are rotatably movable into and out of engagement with said latching surface.

7. The enclosure defined in claim 1 wherein said door latch means further comprises a handle rotatably supported on said door, said handle being disposed on an external surface of said door and having drive means connected with said first and second latching members on an internal surface thereof.

8. The enclosure defined in claim 7 wherein said door latch means further comprises releasable locking means biased into locking engagement with said drive means when said latching members are in latching position relative to said latching surface, and means accessible from said external surface of said door for releasing said locking means permitting operation of said handle and movement of said latching members to a non-latching position.

9. The enclosure defined in claim 8 further comprising means biasing said door latch means to a non-latching position.

10. The enclosure defined in claim 9 wherein said releasable locking means comprises cam means extending beyond said latching surface for engagement therewith upon movement of said door to said closed position, said engagement operating said releasable locking means to release said drive means for movement of said latching members to a non-latching position by said biasing means.

11. The enclosure defined in claim 10 wherein said cam means extends beyond said leading edge of said latching surface to provide a backup latching member.

12. The enclosure defined in claim 7 wherein said second latching means is disposed between a forward edge of said other of said side walls and said door subsequent to venting said arc gases, and said handle is operable to move said first and second latching members to a non-latching position permitting said door to be reclosed at said end thereof to which said second latching member is mounted, or to be pivotally moved about said hinge to said open position.

13. The enclosure defined in claim 1 wherein said latching members are rollers journaled for rotation about axles carried by plates rotatably mounted to said door.

14. The enclosure defined in claim 1 wherein said latching members comprise tabs extending from plates rotatably mounted to said door.

15. The enclosure defined in claim 1 wherein said other of said side walls comprises a front wall extending partially across the front of said box toward said one of said side walls and terminating in a forwardly projecting flange, an interior surface of said front wall being said latching surface and a juncture of said flange and said front wall being said leading edge of said latching surface.

16. The enclosure defined in claim 15 wherein said flange, opposed end walls and said one of said side walls define said open front of said box.

17. The enclosure defined in claim 16 wherein said door further comprises a rearwardly extending peripheral flange overlapping said one of said side walls, said opposed end walls and said forwardly projecting flange.

18. The enclosure defined in claim 15 wherein a juncture of said front wall and said forwardly projecting flange comprise said leading edge, said juncture being a radiused corner, and said latching members have rounded edges engaging with said radiused corner when moved to engage said latching surface.

19. An enclosure containing electrical switching apparatus comprising:

a box comprising a rear wall, opposed pairs of side and end walls extending forwardly from said rear wall, an open front, a door hinged along one of said side walls for pivotal movement between an open position and a closed position overlying said open front, and a latching surface near a forward edge of the other of said side walls;

a gasket disposed between said door and peripheral edges of said open front when said door is closed;

door latch means comprising first and second latching members mounted to said door in proximity to opposite ends thereof, said latching members being movable to engage said latching surface and cam said door to said closed position compressing said gasket, said first latching member being arranged to extend a greater distance beyond a leading edge of said latching surface than said second latching member;

said one of said side walls being distortable outwardly along its forward edge upon increased pressure within said box caused by arc gases generated by fault currents in said switching apparatus, distortion of said one of said side walls moving said door laterally away from said other of said side walls to pull said second latching member free of said leading edge of said latching surface, said pressure thereafter forcing a respective end of said door at which said second latching member is mounted outward in an opening direction to exhaust said arc gases before said first latching member is pulled free of said leading edge, said first latching member cooperating with said latching surface to maintain said door substantially in said closed position.

* * * * *